US006612970B2

(12) United States Patent
Forcillo

(10) Patent No.: US 6,612,970 B2
(45) Date of Patent: Sep. 2, 2003

(54) ADJUSTABLE STATIONARY EXERCISE BICYCLE

(76) Inventor: John Forcillo, 164 St. Louis, St. Eustache Quebec (CA), J7R 1Y3

( * ) Notice: Subject to any disclaimer, the term of this patent is extended or adjusted under 35 U.S.C. 154(b) by 0 days.

(21) Appl. No.: 10/008,414

(22) Filed: Nov. 13, 2001

(65) Prior Publication Data

US 2003/0092534 A1 May 15, 2003

(51) Int. Cl.[7] ..... A63B 22/00
(52) U.S. Cl. ..... 482/57; 482/63
(58) Field of Search ..... 482/51–53, 57–65, 482/117–120

(56) References Cited

U.S. PATENT DOCUMENTS

| | | | | |
|---|---|---|---|---|
| 3,622,153 A | * | 11/1971 | Thompson | 482/60 |
| 4,265,447 A | | 5/1981 | Shafer | |
| 4,577,860 A | | 3/1986 | Matias et al. | |
| 4,671,396 A | | 6/1987 | Kotamaki | |
| 5,643,153 A | | 7/1997 | Nylen et al. | |
| 5,823,919 A | | 10/1998 | Eschenbach | |
| 5,916,065 A | | 6/1999 | McBride | |
| 5,961,423 A | | 10/1999 | Sellers | |
| 5,961,424 A | * | 10/1999 | Warner et al. | 482/63 |
| 5,980,431 A | | 11/1999 | Miller | |
| 6,099,440 A | | 8/2000 | Schurter et al. | |
| 6,491,606 B1 | * | 12/2002 | Swift | 482/57 |

FOREIGN PATENT DOCUMENTS

DE 297 17 853 U1 8/1997

* cited by examiner

*Primary Examiner*—Stephen R. Crow
(74) *Attorney, Agent, or Firm*—Don W. Weber

(57) ABSTRACT

A new and unique highly adjustable stationary exercise bicycle for children or adolescents is presented incorporating a number of features specifically designed for youthful stationary bicycle users. The improvements over the prior art include infinitely adjustable vertical and horizontal seat heights and handlebar heights which are secured in their positions by a quick release lever rather than the standard pop pins. Also included are ports which allow the surface between the friction member and the working wheel to be lubricated. An emergency brake for the working wheel as well as a quick way to disengage the working wheel from the pedals is provided. A one-way directional clutch bearing also allows the user to "coast" on the bicycle, with the pedals remaining stationary while the working wheel is still moving. Special pedal cage brackets are placed around each pedal so that the youth's use of such an exercise bicycle is made much more safely. All of the above elements combine to make this stationary exercise bicycle safe for use by children or adolescents.

4 Claims, 6 Drawing Sheets

ADJUSTABLE STATIONARY EXERCISE BICYCLE

BACKGROUND OF THE INVENTION

This invention relates to the field of exercise equipment. More particularly, an exercise bicycle having numerous adjustments for size and workload is presented.

In the field of exercise equipment, stationary bicycles have become both useful and popular in the last few decades. The stationary bicycles currently in existence basically take the standard bicycle used on the roads and add either platforms or other framework such that the bicycle does not move. Various types of these stationary bicycles have been designed, including bicycles that entirely eliminate the back wheel. The bicycles usually have a seat and handlebars to simulate a regular bicycle but the pedals are connected to a front wheel that does not touch the floor.

Since obesity in North America is growing at a tremendous rate, innovations in the field of exercise equipment, particularly exercise bicycles, is quite desirable. With the advent of computers and television, children are becoming somewhat lazy and undisciplined. Children, in particular, need specialized equipment in order to keep up their exercise regiment.

Although many stationary exercise bicycles have been designed for adults, none have, as yet, been designed especially for children. A child's physical stature, as well as his somewhat inattentiveness to detail, necessitate a few important changes in the basic design of a stationary exercise bicycle. It is an object of this invention to provide an exercise bicycle designed especially for children or young adults.

One of the main advantages of a junior exercise bicycle is that the youngster can ride in the comfort of his home, thus exercising while still being entertained by their favorite music or television show. Further, while youth facilities are in big demand today, these gym facilities oftentimes only have equipment for adults. By creating an exercise bicycle developed especially for children, youngsters can make use of the gym facilities along with their adult parents or guardian, giving all participants a quality time together while increasing the fitness of adult and child alike. Studies with local universities and youth centers have proven that by working out in a group, the youth discipline and attentiveness is increased.

One of the problems encountered in the adult stationary exercise bicycle is that the smaller physique of children often prohibits them from using the exercise bicycle. For example, the positioning of the seat is very important for the comfort of the user. It is an object of this invention to provide a seat which may be specially adjusted to position a child to fit perfectly onto the stationary bicycle while still keeping in mind his growth patterns.

In addition to the height adjustment of the seat, it is also important to be able to adjust the height of the handlebars on the stationary bicycles. These adjustments have previously been made by the use of pop pins. However, pop pins are often not safe, particularly when used by inattentive youngsters. Further, pop pins also are not precise with respect to the spinal and leg adjustments. Pop pins utilize a series of incremental holes so that the adjustments must be made in incremental steps specified by the manufacturer. It is a further object of this invention to provide vertical and horizontal adjustments for the seat and height adjustments for the handle posts of a stationary bicycle such that they can be set at an infinite number of positions within the specified overall range. It is a still further object of this invention to provide for adjustments for the seat and handle posts of a stationary bicycle by means of a quickly releasable handle rather than a pop pin.

In the manufacture of exercise bicycles, it has been found that the tension placed on the exercise wheel could create a slight but irritating squeaking noise. Further, for children in particular, it is highly desirable to have the exercise wheel made such that the operator can coast, with the pedals remaining stationary even though the wheel is still moving forward. Further, for children's exercise bicycles in particular, it is also highly desirable that an emergency brake system or total release system be in place. The addition of these features greatly enhances the performance and safety of an exercise bicycle. These objects and other enhancements of this invention will become apparent upon reading the below-described Specification.

BRIEF DESCRIPTION OF THE DEVICE

A stationary exercise bicycle is presented having an adjustable seat and handlebars attached to a bottom frame. The frame also supports standard pedals and stems which are attached to a front exercise wheel. The vertical height and horizontal position of the seat is infinitely adjustable within a broad range by means of a quick attach handle. The height of the handlebars may be similarly adjusted by means of a quick attach handle. The tension on the front exercise wheel is adjustable and squeaking is kept to a minimum by the introduction of lubricating oil through a number of specially designed lubricating ports. The tensioning handle also has an emergency stop brake as well as a means for momentarily disengaging all friction on the wheel to facilitate a dismount. The working exercise wheel also has a directional clutch bearing such that the action of a modern bicycle is simulated. When the child using the exercise bicycle quits pedaling, the directional clutch allows the working wheel to continue in the clockwise position while providing no directional force to the pedals, which may then remain stationary. A special foot pedal bracket also keeps the child's foot securely in contact with the pedal as desired.

BRIEF DESCRIPTION OF THE DRAWING FIGURES

DETAILED DESCRIPTION OF THE PREFERRED EMBODIMENT

Figure 1:
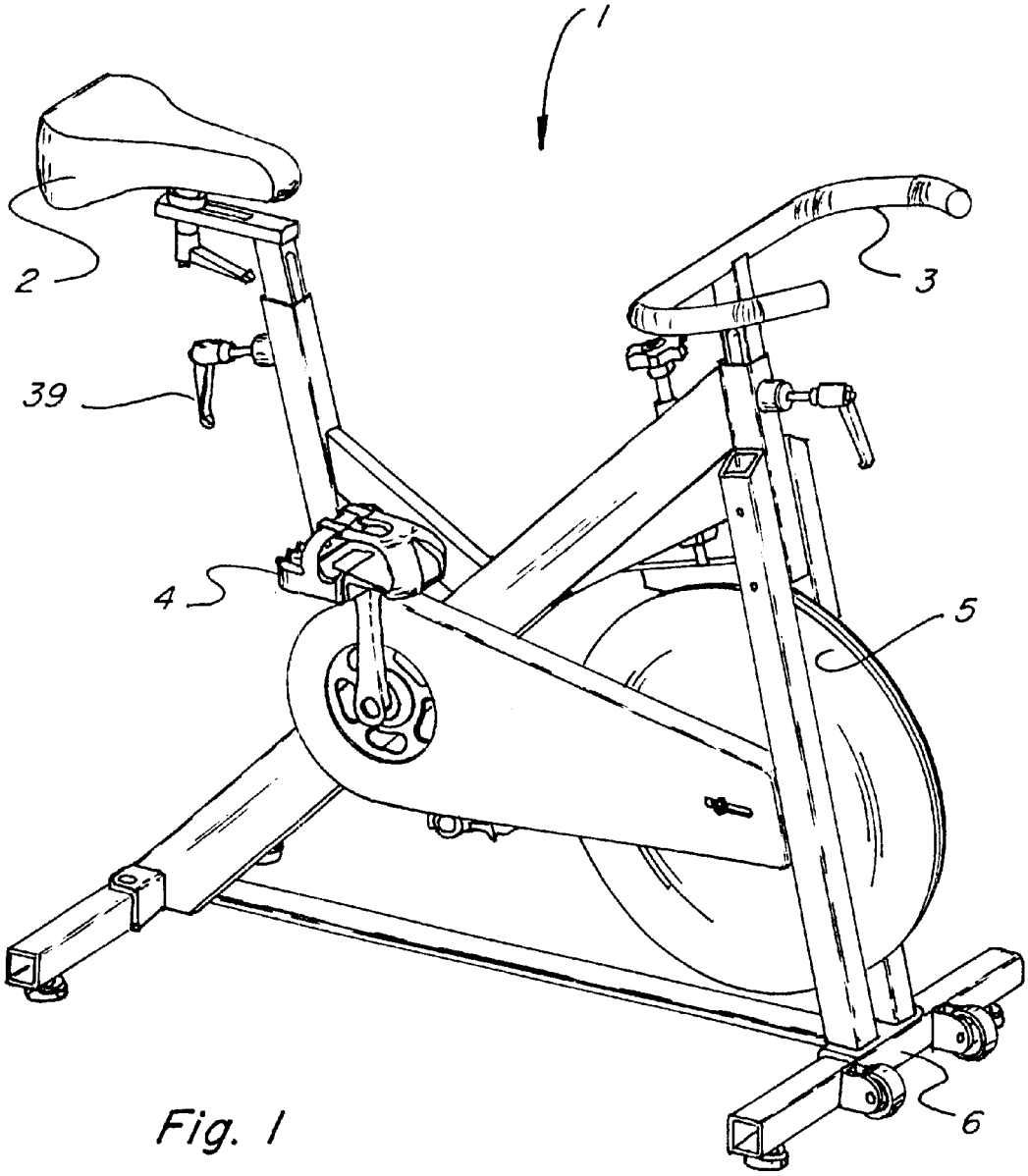
FIG. 1 is a perspective view of the child's stationary exercise bicycle.
Figure 1A:
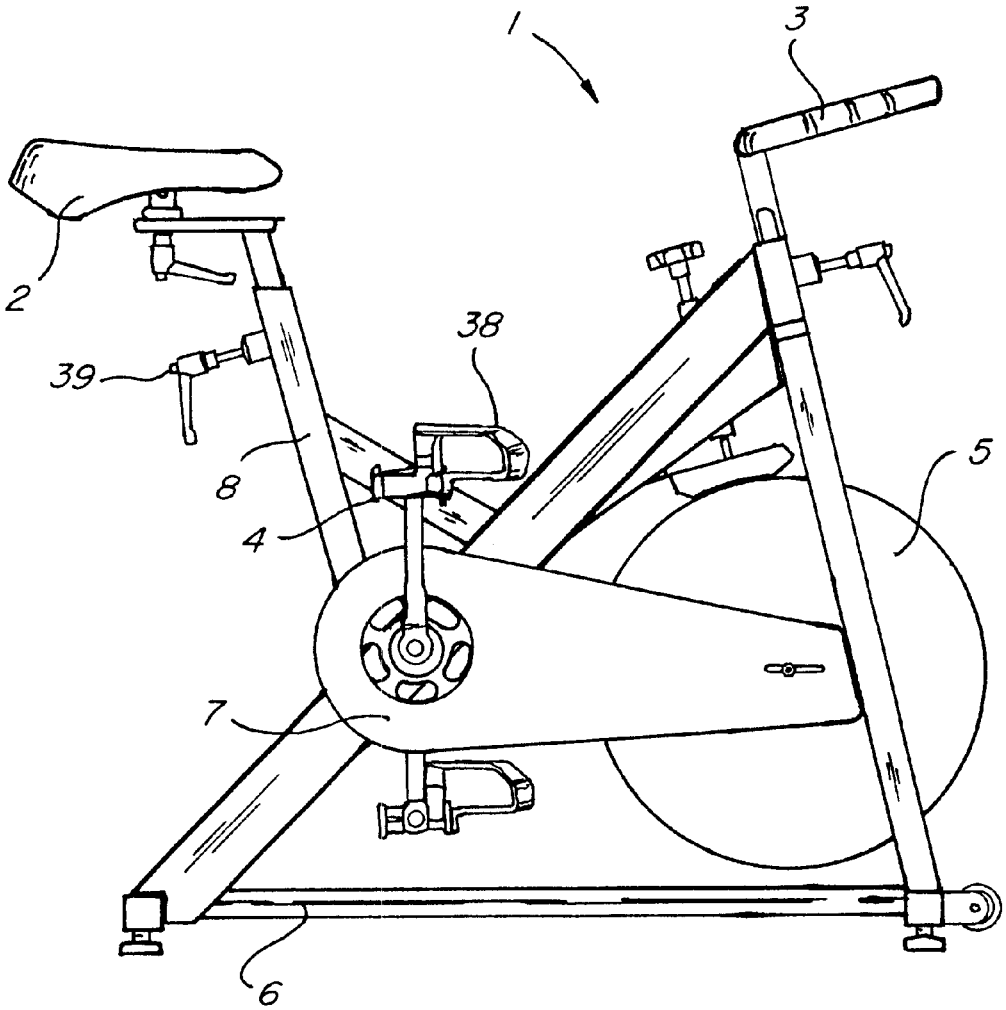
FIG. 1A is a side view of the child's stationary exercise bicycle.

A child's stationary exercise bicycle 1 is shown in FIGS. 1 and 1A. This is the general configuration of stationary exercise bicycles now common throughout North America, except that the instant device is smaller in size than an adult device. The basic elements of the stationary exercise bicycle include a seat 2, handlebars 3, pedals 4, and a working exercise wheel 5. These elements are all attached to a lower frame 6, as shown in FIGS. 1 and 1A. The pedals 4 are also attached to the working exercise wheel 5 by means of a chain or belt, which is enclosed in the drive guard 7.

Figure 2A:
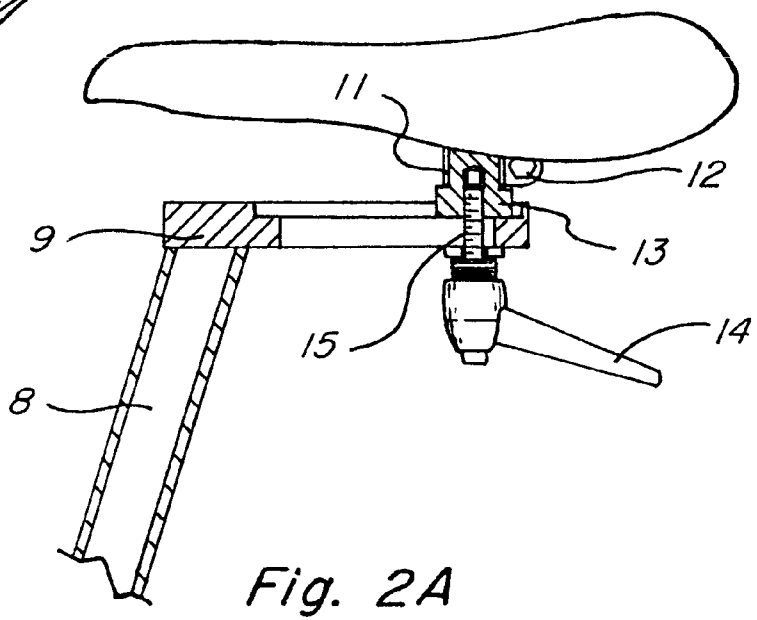
FIG. 2A is a side cutaway view of the bicycle seat and support mechanism.
Figure 2:
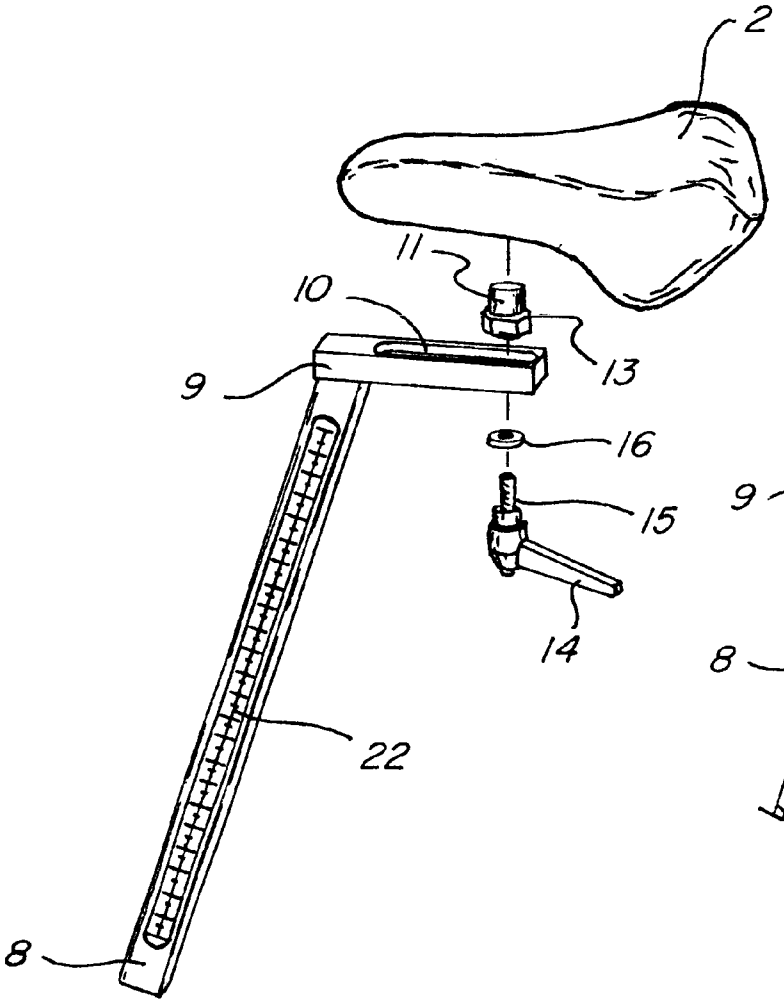
FIG. 2 is a partial side exploded view of the bicycle seat and support mechanism.

Turning to FIGS. 2 and 2A, the seat and seat support mechanism are shown. The seat 2 is attached to an oblique seat support 8. This oblique seat support 8 also has a horizontal base 9 attached at its upper end. The oblique seat support 8 has a height gauge 22 inscribed on the outer surface thereof. The horizontal seat base 9 has a horizontal groove 10 cut into the upper portion of the seat base. A seat peg 11 is adapted to attach to the seat 2. This seat peg 11 has a vertical shaft, which is attached to the seat by means of the standard double bolt mechanism 12.

Once the seat 2 has been firmly attached to the seat peg 11, the lower head 13 of the seat peg 11 is inserted into the horizontal seat base groove 10. Because the sides of the lower head 13 are flat, and because the groove 10 has flat sides, the seat is prevented from rotating.

The seat 2 is slidably yet firmly attached to the horizontal seat base 9 by means of the seat release lever 14. The seat release lever 14 has an upper threaded shaft 15 which mates with the female shaft threads located on the inside of the seat peg 11. A washer 16 is also utilized to keep the mechanism tightened.

The seat may be adjusted either towards the handlebars or away from the handlebars by means of the quick release handle 14 across an infinite number of positions limited only by the length of groove 10. The groove defines the limits of the broad range of adjustments. The vertical height of the seat 2 is similarly infinitely adjustable across the broad range of adjustments by use of a seat height lever 39. The seat lever 39 functions in the same manner as lever 14.

Figure 3:
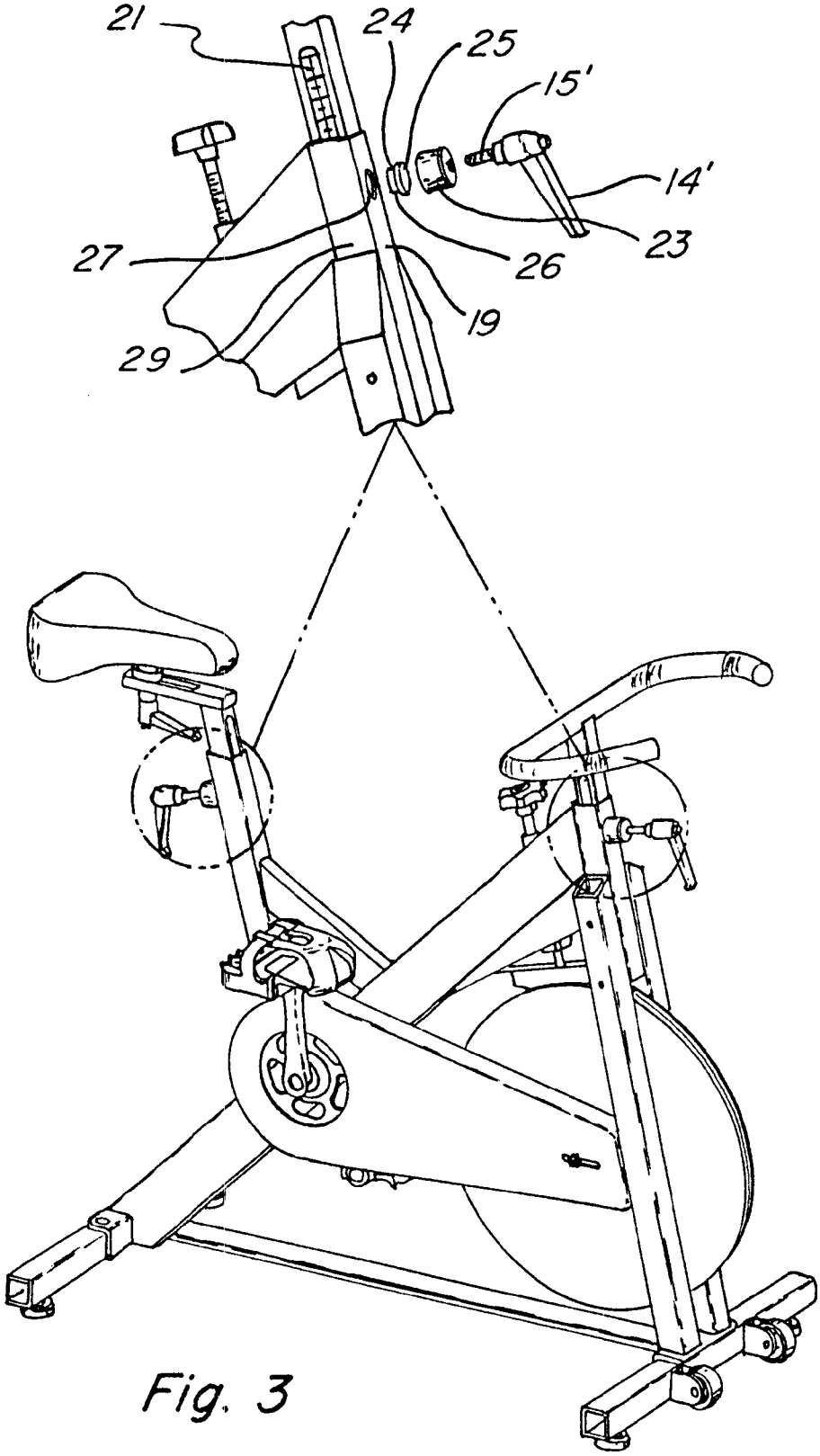
FIG. 3 is a perspective exploded view of the quick release system for the bicycle handlebars and support.
Figure 3B:
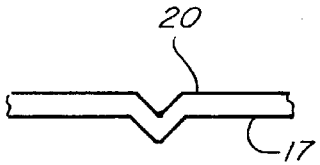
FIG. 3B is a side cutaway view of the front surface of the handle bar support and the bicycle support.
Figure 3A:
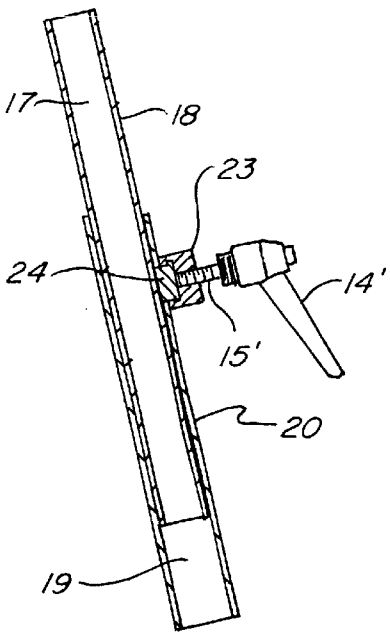
FIG. 3A is a side cutaway view of the quick release system for the handlebars and handle bar supports.

The vertical height of the handlebars may also be adjusted as illustrated in FIGS. 3 and 3A. The handlebars are attached to an oblique handlebar support 17. This handlebar support has an essentially rectangular cross section. The front surface 18 of the handlebar support 17 has a V-shaped indentation. This V-shaped indentation is best shown in FIG. 3B. The handlebar support slides into the bicycle front support 19. The bicycle front support 19 also has an essentially rectangular cross section, and is attached to the lower frame 6, as shown in FIG. 1. One outer surface 20 of the bicycle front support 19 has a corresponding protruding V-shaped surface, as shown in FIG. 3B. The protruding V-shaped surface of the front support 19 corresponds to the V-shaped indentation of the front surface of the handlebar support 17. This V-shaped protrusion and channel keep the handlebars in firm orientation with the front support 19 such that the handlebars do not sway back and forth when the user is alternating weight between the left and right handlebars.

The oblique handlebar support 17 slides inside the bicycle front support 19 such that the height of the handlebars may be infinitely adjusted across the range of adjustments defined by the length of the handlebar support 17. The height of the handlebars may be set specifically by means of the ruler scale 21, as shown on FIG. 3. Rather than using a pop pin mechanism which allows only for the seat or handlebar adjustments to be made incrementally according to the spacing of the preset holes, both the seat 2 and handlebars 3 in the present invention may be infinitely adjusted over the broad range of height and horizontal adjustments as measured by the handlebar ruler scale 21 and the seat scale 22.

As best shown in FIGS. 3 and 3A, the adjustment of the handlebars may be made using a threaded quick release lever 14' similar to the quick release lever 14 used for the seat adjustment. This quick release lever 14' also has a threaded shaft 15'. A threaded spacer 23 is permanently affixed to the front surface 20 of the bicycle support 19. Inside this threaded spacer 23 is located a brass pill 24. This brass pill 24 has an upper head 25 and a lower shaft 26 as shown on FIG. 3. The brass pill head 25 creates a flange, which prohibits the entire brass pill 24 from going through the adjusting hole 27. As best shown in FIG. 3A, once the oblique handlebar support 17 has been correctly positioned, the quick attach lever 14' is turned such that the shaft 15' tightens the brass pill 24 which in turn secures the handlebar support 17 in stationary position with respect to the bicycle front support 19.

Figure 4:
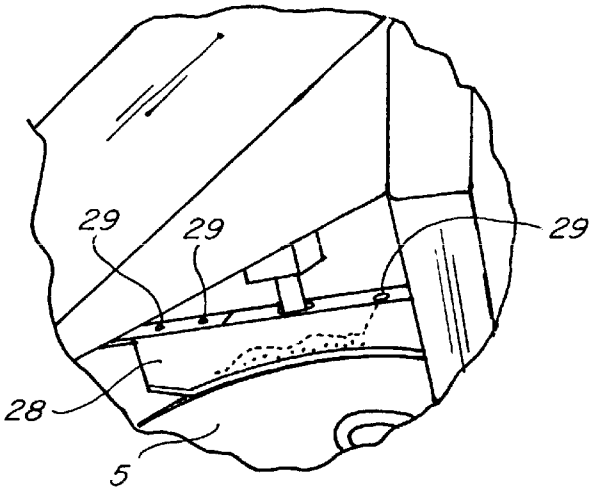
FIG. 4 is a detailed view of the lubricating ports and lubricating mechanism.

Another improvement over standard exercise bicycles is best shown in FIG. 4. FIG. 4 is an expanded view of the tensioning and lubricating mechanism of this device. When one sits on the bicycle and moves the pedals 4 in a clockwise direction, the drive mechanism located underneath the drive guard 7 between the pedals 4 and the working exercise wheel 5 moves the wheel. The clockwise motion of the pedals moves the exercise wheel 5 in a clockwise direction. In order to create the desired amount of friction, thus causing the work to increase or decrease, a friction piece 28 is pressed against the outer circumference of the wheel 5. The more firmly the friction piece 28 is pressed against the wheel 5, the more friction is created and the harder it is to turn the pedals 4.

Creating this friction between the friction piece 28 and wheel 5 will often cause squeaking. In order to alleviate this squeaking noise, the top and body of the friction piece 28 has drilled through it a plurality of friction piece ports 29. These ports 29 communicate between the top and the lower surface of the friction piece. A special Teflon lubricating oil may be inserted into the plurality of the ports 29 to lubricate the corresponding surfaces between the friction piece 28 and the working exercise wheel 5.

The friction between the friction piece 28 and the exercise wheel 5 is adjusted by means of a friction adjusting shaft 30. A friction adjusting shaft mechanism is fairly common throughout the stationary exercise bicycle industry. Essentially the shaft 30 is positioned in a cylinder 31 such that the friction piece 28 may be moved towards or away from the working wheel 5 by a screw-type mechanism. The cylinder 31 is affixed to the cross-bar 33 of the frame.

Figure 5:
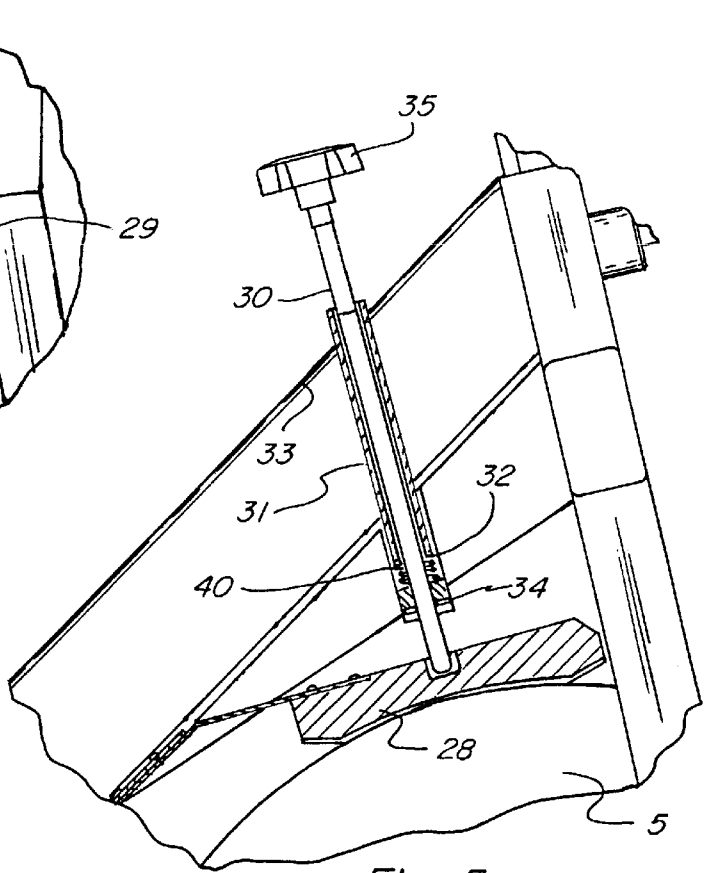
FIG. 5 is a detailed cutaway view of the exercise wheel tensioning system and the brake and quick release mechanism.

However, as best shown in FIG. 5, a unique spring biassing mechanism found only in the instant stationary exercise bicycle allows for a quick release of the wheel or for an instant brake of the wheel. A friction-tightening nut 34 is threaded and adapted to receive the threaded shaft 30 of the friction adjustment mechanism. The nut 34 may slide up or down in the cylinder 31 but does not rotate since it has the same square shape as the lower end of the shaft. The lower end of the friction adjustment shaft 30 is also attached to the friction piece 28. The threaded shaft is contained within the cylinder 31. Turning the threaded friction adjustment shaft 30 either moves the tightening nut 24 away from or towards the working exercise wheel 5.

A special friction adjusting shaft spring 32 is located in the lower of the friction adjusting shaft cylinder 31. A flange 40 holds the spring 32 in the lower portion of cylinder 31 as shown on FIG. 5. Tightening nut 34 compresses spring 32 and increases the friction between piece 28 and wheel 5. Loosening nut 34 decreases the friction.

When it is necessary to stop the movement of the wheel 5 immediately, the handle 35 of the mechanism is simply pushed down, compressing the shaft spring 32. This pushes the friction piece 28 tightly against the wheel 5 and stops rotation of the wheel. It has been found that this type of emergency quick stop mechanism is necessary for applications involving children. Children are sometimes careless or inattentive to the motion of the exercise bicycle and a quick stop emergency mechanism such as the one described is deemed highly advisable. Alternatively, if the friction adjusting shaft handle 35 is raised, the wheel may then be disengaged from the friction piece and spin freely. Moving the handle 35 upwards disengages the friction piece 28 from the moving wheel 5 and enables a person, particularly a child or adolescent, to easily and safely alight from the exercise bicycle.

Many bicycles actually used on the road are positively attached between the pedals and the wheels by a chain. Because of this positive attachment, the pedals continue to move as long as the wheel moves. On some newer bicycles, a directional clutch system is used such that the wheels can continue to turn while the pedals are disengaged due to a directional clutch system. Such a system has been specifically adapted herein in order to allow the pedals to remain stationary while the working exercise wheel continues to rotate in the clockwise direction. This system is shown particularly in FIGS. 6, 6A and 6B.

Figure 6:
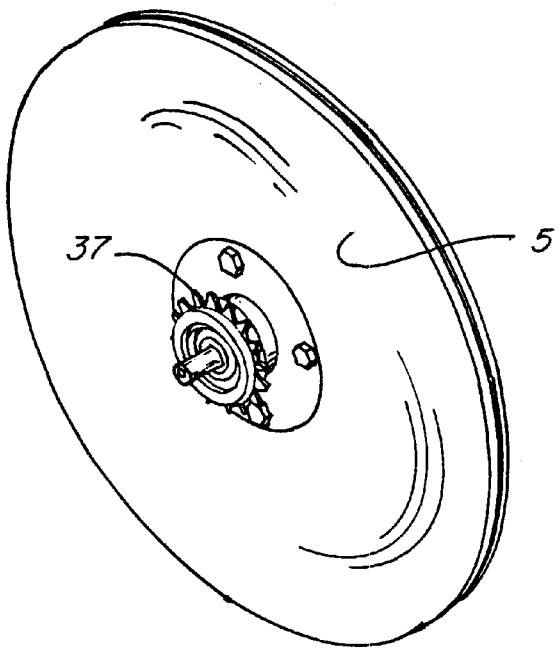
FIG. 6 is a perspective view of the working exercise wheel.

FIG. 6 is a perspective view of the working exercise wheel 5. The working exercise wheel is composed of a hub 36 and a clockwise directional clutch bearing 37. The hub, wheel, and bearing are affixed to the lower frame 6 as best shown in FIGS. and 1 and 1A.

Figure 6A:
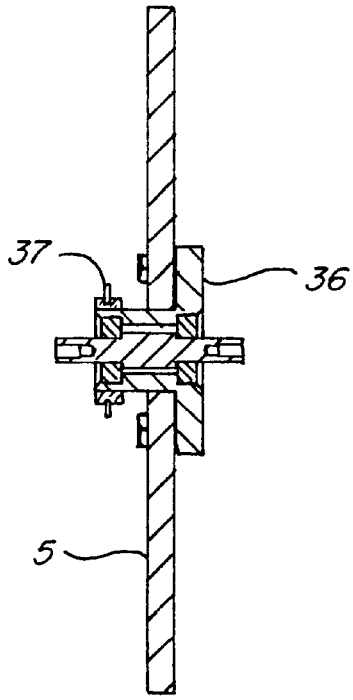
FIG. 6A is a cutaway view of the working exercise wheel taken along the diameter of the exercise wheel shown in FIG. 6.
Figure 6B:
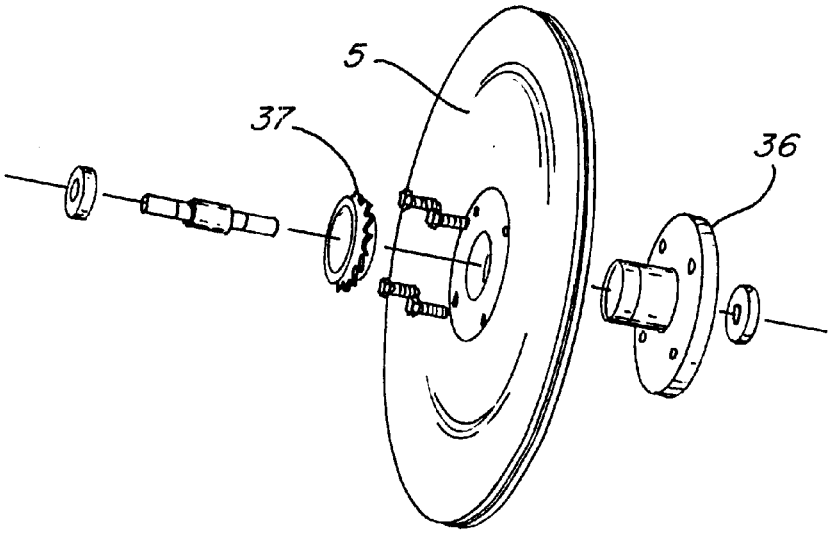
FIG. 6B is an exploded view of the working exercise wheel and hub system.

It has been found that, particularly for child or adolescent applications, the directional clutch bearing mechanism shown in FIGS. 6, 6A and 6B enhances the comfort, safety, and overall utility of the device.

A final improvement in this exercise bicycle is shown in FIG. 1. This improvement comprises a suitable cage placed around each pedal. This cage 38 keeps the child's or adolescent's foot snugly secured to the pedal 4. This pedal cage 38 allows the foot to remain in contact with the pedal even when the foot and pedals are rapidly rotating. It has been found that a safety feature such as the pedal cage 38 greatly enhances the safety and overall utility of the child and adolescent stationary exercise bicycle in particular.

While many of the aforementioned elements of the stationary exercise bicycle are common throughout the industry, the specific incorporation of the infinitely adjustable seat and handlebars, the quick release mechanisms for the adjustment of the seat and handlebars, the special lubricating elements of the device, the emergency stop and emergency release of the working wheel, as well as the clutch mechanism of the wheel and the pedal cage are all improvements over the prior art. While some of these elements have been incorporated into regular road use bicycles, incorporating these features into a stationary exercise bicycle is new and novel in the art.

Having fully described my device, I claim:

1. An adjustable exercise bicycle, comprising:

(a) a frame, including a cross-bar, said frame supporting and attached to a seat, handlebars and a working wheel, also comprising pedals rotatably attached to said frame and operatively connected to said working wheel;

(b) an adjustable friction piece mechanically in contact with said working wheel; and (c) a tensioning and quick brake and disengagement means comprising:

a friction adjusting cylinder having a longitudinal bore said cylinder comprising a top end attached to said frame, a lower portion adapted to receive a tightening nut such that said nut may slide up and down in the lower portion of said cylinder but will not rotate, and a lower end located near said friction piece, said lower end having an inner flange, a threaded tightening shaft located within the longitudinal bore of said adjusting cylinder, having a top end, threaded lower portion, and a lower end, said lower end being in contact with said friction piece;

a tightening nut slidably located in the lower portion of said adjusting cylinder, threadedly attached to the lower portion of said tightening shaft; and a tensioning spring, located around the lower portion of said shaft, under said flange and above said tightening nut;

wherein said cylinder, shaft, nut and spring cooperate to adjust the tension on said friction piece and wherein the top end of said threaded shaft may be pushed or pulled, respectively, to quickly brake said wheel or quickly disengage said pedals from said wheel.

2. An adjustable exercise bicycle, comprising:

(a) a frame including a front support, said frame supporting a scat and slidably adjustable handlebar means, and a working wheel, also comprising pedals rotatably attached to said frame and operatively connected to said working wheel; and (b) a friction piece mechanically in contact with said wheel;

wherein said handlebar adjusting means comprises:

a handlebar attached to the top of a handlebar support, said handlebar support slidably located in said bicycle front support;

a threaded spacer attached to said bicycle front support at an adjusting hole;

a tightening pill, said pill comprises an upper head flange and a lower pill shaft, said pill adapted to be inserted inside said threaded spacer, wherein said flange prohibits said pill from going through said adjusting hole; and a quick release lever having a handle and a threaded shaft, wherein said threaded shaft is adapted to be threadedly inserted into said spacer;

wherein said handlebar support may be adjustably secured inside of said bicycle front support by said lever and tightening pill.

3. An adjustable exercise bicycle as in claim 2, wherein said handlebar support has at least one essentially flat surface, said flat surface having a V-shaped indentation and wherein said bicycle front support has a protruding V-shaped surface corresponding to said V-shaped surface of said handlebar support.

4. An adjustable exercise bicycle, comprising:

(a) a frame, a seat, handlebars and a working wheel attached to said frame and, also comprising pedals rotatably attached to said frame and operatively connected to said working wheel; and (b) a friction piece comprising a top, a body and a lower surface, said lower surface being in mechanical contact with said working wheel, wherein said top, body and lower surface have a plurality of lubricating port holes therethrough, said holes communicating between the top and lower surface of said friction piece, wherein lubricating oil may be inserted into said ports from the top to lubricate the surfaces between said friction piece and said wheel.

* * * * *

UNITED STATES PATENT AND TRADEMARK OFFICE

CERTIFICATE OF CORRECTION

PATENT NO. : 6,612,970 B2
DATED : September 2, 2003
INVENTOR(S) : John Forcillo

It is certified that error appears in the above-identified patent and that said Letters Patent is hereby corrected as shown below:

Column 6,
Line 32, "pedals" should be deleted and in its place -- friction piece -- should be inserted.

Signed and Sealed this

Thirteenth Day of January, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,612,970 B2
DATED : September 2, 2003
INVENTOR(S) : John Forcillo

It is certified that error appears in the above-identified patent and that said Letters Patent is hereby corrected as shown below:

Column 1,
Line 4, insert:
-- This is a continuation-in-part of U.S. Application Serial No. 09/696,948, filed on October 27, 2000, now United States Patent No. 6,669,603, which was a continuation of U.S. Application Serial No. 09/263,858 filed on March 8, 1999 (now abandoned). --

Column 5,
Line 3, the numeral "24" should correctly be -- 34 --.

Signed and Sealed this

Twenty-eighth Day of June, 2005

JON W. DUDAS
*Director of the United States Patent and Trademark Office*